US006206758B1

(12) United States Patent
Lai et al.

(10) Patent No.: US 6,206,758 B1
(45) Date of Patent: Mar. 27, 2001

(54) METHOD FOR INCREASING WORKING LIFE OF RETAINING RING IN CHEMICAL-MECHANICAL POLISHING MACHINE

(75) Inventors: Chien-Hsin Lai, Kaohsiung Hsien; Juen-Kuen Lin, Kaohsiung; Peng-Yih Peng, Hsinchu Hsien, all of (TW)

(73) Assignee: United Microelectronics Corp., Shinchu (TW)

( * ) Notice: Subject to any disclaimer, the term of this patent is extended or adjusted under 35 U.S.C. 154(b) by 0 days.

(21) Appl. No.: 09/114,435

(22) Filed: Jul. 13, 1998

(30) Foreign Application Priority Data

Apr. 21, 1998 (TW) ..... 87106057

(51) Int. Cl.[7] ..... B24B 7/00

(52) U.S. Cl. ..... 451/41; 451/287; 451/288

(58) Field of Search ..... 451/288, 287, 451/41

(56) References Cited

U.S. PATENT DOCUMENTS

| | | | | |
|---|---|---|---|---|
| 3,791,457 | * | 2/1974 | Hanser et al. | 172/781 |
| 4,025,136 | * | 5/1977 | Ballendux | 308/207 |
| 4,408,636 | * | 10/1983 | Karpenko | 138/94 |
| 4,562,946 | * | 1/1986 | Ryan | 226/95 |
| 4,813,600 | * | 3/1989 | Schultz et al. | 239/88 |
| 5,002,418 | * | 3/1991 | McCown et al. | 403/24 |
| 5,862,902 | * | 1/1999 | Howrie | 192/84.961 |

* cited by examiner

*Primary Examiner*—Joseph J. Hail, III
*Assistant Examiner*—William Hong
(74) *Attorney, Agent, or Firm*—Jiawei Huang; J.C. Patents

(57) ABSTRACT

A method for increasing the working life of retaining rings in a chemical-mechanical polishing machine. The method includes adding an extra pad between a retaining ring and a carrier so that the retaining ring is prevented from slippage and pressure on wafer can be evenly spread over the polishing pad of a polishing machine. Therefore, the rate at which a retaining ring wears out in chemical-mechanical polishing operation can be greatly reduced, and the working life of a retaining ring can be doubled.

11 Claims, 3 Drawing Sheets

METHOD FOR INCREASING WORKING LIFE OF RETAINING RING IN CHEMICAL-MECHANICAL POLISHING MACHINE

BACKGROUND OF THE INVENTION

1. Field of Invention

The present invention relates to a chemical-mechanical polishing machine. More particularly, the present invention relates to a method for increasing the working life of a retainer ring used in a chemical-mechanical polishing machine.

2. Description of Related Art

In the fabrication of semiconductor devices, planarizing a wafer surface is an important process before high-density microlithographic techniques can be carried out. Planarization is necessary because only when surface topographic variations are removed can diffraction of light be avoided, and, consequently, transfer of a highly accurate pattern be achieved. Currently, the two main techniques for planarizing a wafer surface include spin-on-glass (SOG) and chemical-mechanical polishing (CMP). However, ever since semiconductor fabrication has reached the sub-half micron stage, spin-on-glass technique is insufficient for providing the degree of planarity necessary for a wafer. This leaves chemical-mechanical polishing as the only means for global planarization of very large scale integration (VILSI) or even ultra large scale integration (LJLSI) circuits. Since chemical-mechanical polishing is such an important planarization techniques, various semiconductor manufacturers and research organizations are participating in the development of CN/tp techniques in order to get a head start in the field.

FIGS. 1A and 1B are respective top-view and side-view of the components of a conventional chemical-mechanical polishing machine. Components of a chemical-mechanical polishing machine include: a polishing table 10; a polishing pad 13 on top of the polishing table 10; a carrier 21 and a retaining ring 20 for grabbing a wafer 12; a spinning axle 11 for rotating the carrier 21, a transporting pipe 14 for transporting slurry 19 to the polishing pad 13; and a pump 15 for pumping the slurry 19 through the transporting pipe 14. When chemical-mechanical polishing starts, the polishing table 10 and the axle 11 will both rotate separately in a predefined direction, as shown by arrows 18*a* and 18*b* in FIGS. 1A and 1B. Carrier 21 grabs the back of the wafer 12, which is retained in place by the retaining ring 20. The wafer 12 is pressed with its front face 17 onto the polishing pad 13. Slurry 19 running through the transporting pipe 14 driven by the pump 15 is constantly dropping onto the polishing pad 13. Polishing is achieved through chemical reaction between the chemical reagent inside the slurry 19 and the silicon on the front face 17 of the wafer 12. The chemical reaction produces an easy-to-polish layer on the front face 17. Moreover, abrasive particles inside the slurry 19 also offer some assistance in removing the protruding parts in the easy-to-polish layer. Therefore, by repeating the above chemical reaction and mechanical polishing action, a surface of high planarity can be obtained. In general, chemical-mechanical polishing is a process that uses mechanical polishing together with chemical reaction through special chemical reagents to smooth out and planarize a highly irregular wafer surface.

FIG. 2 is a cross-sectional view showing the location of pocket depth in a wafer holding assembly. As shown in FIG. 2, one end of a retaining ring 20 is connected to the periphery of the lower surface of a carrier 21. A wafer is fixed in position by the carrier 21 and the retaining ring 20. In FIG. 2, the pocket depth 22 refers to the distance from the front face 17 of the wafer 12 to the other end of the retaining ring 20. During chemical-mechanical polishing operation, a pocket depth 22 of about 0.3 mm must be maintained so that the slurry on the polishing pad 13 can execute the best possible polishing action.

However, the retaining ring 20 is also be worn away under repeated cycles of chemical reaction and mechanical polishing action. In general, a newly installed retaining ring 20 has a thickness of about 6.35 mm. When the thickness of the retaining ring 20 has worn down to about 5.6 mm, pocket depth 22 can no longer be adjusted to about 0.3 mm. Under such circumstances, the old retaining ring 20 has to be replaced. Normally, a new retaining ring 20 is able to polish roughly between 1500 to 2000 wafers before its working life is finished. Because the retaining ring is made from a rather expensive ceramic material, any method that can increase the working life of the retaining ring can save considerable operating costs.

In light of the foregoing, there is a need to develop a method for increasing the working life of a retaining ring.

SUMMARY OF THE INVENTION

Accordingly, the present invention is to provide a method for increasing the working life of an expensive retaining ring used in a chemical-mechanical polishing machine so that the operating cost of a CMP machine can be reduced. The method is to add a pad between the retaining ring and the carrier in the wafer holding assembly. The extra pad is able to prevent unwanted slippage of the retaining ring and evenly spread out pressure on the wafer. Therefore, useful life of the retaining ring is extended.

To achieve these and other advantages and in accordance with the purpose of the invention, as embodied and broadly described herein, the invention provides a method for increasing the working life of a retaining ring. The method is used in a chemical-mechanical polishing machine that has a carrier and a retaining ring. The carrier and the retaining ring are used for grabbing a wafer firmly when the chemical-mechanical polishing machine is in operation. The method of increasing the working life of the retaining ring includes placing an additional pad between the carrier and the retaining ring. Therefore, when the wafer is being polished, the retaining ring is protected from slippage that may result in unnecessary wear.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
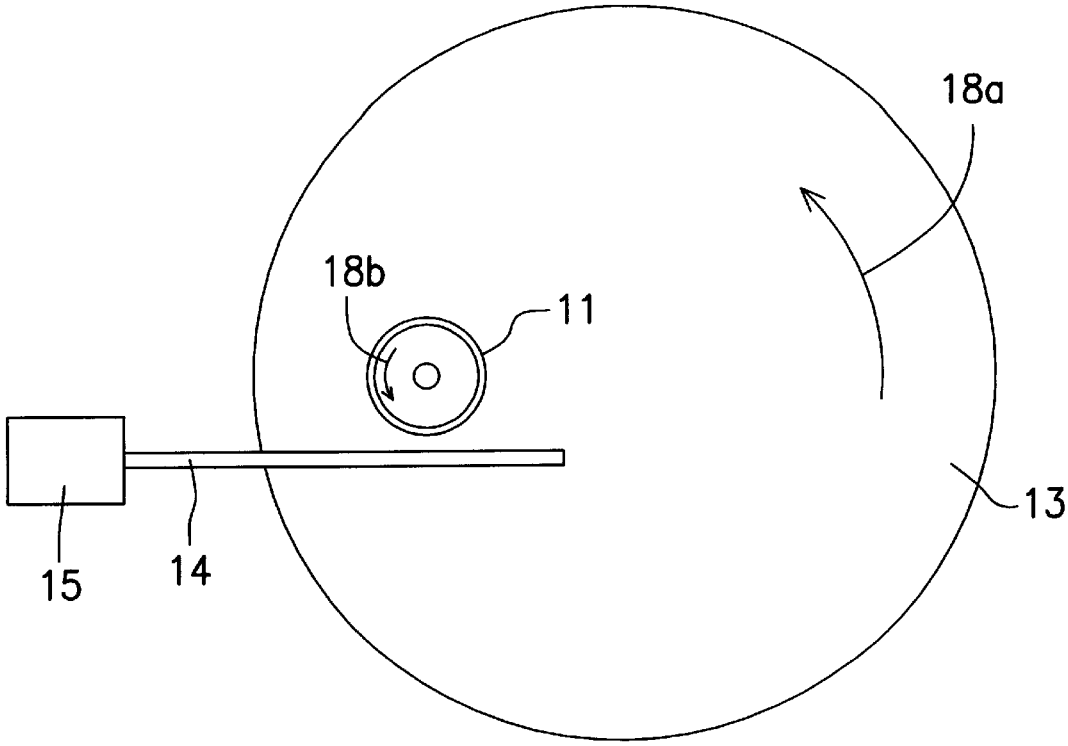
FIG. 1A (PRIOR ART)
FIG. 1A is a top-view of the components in a conventional chemical-mechanical polishing machine.
Figure 1B:
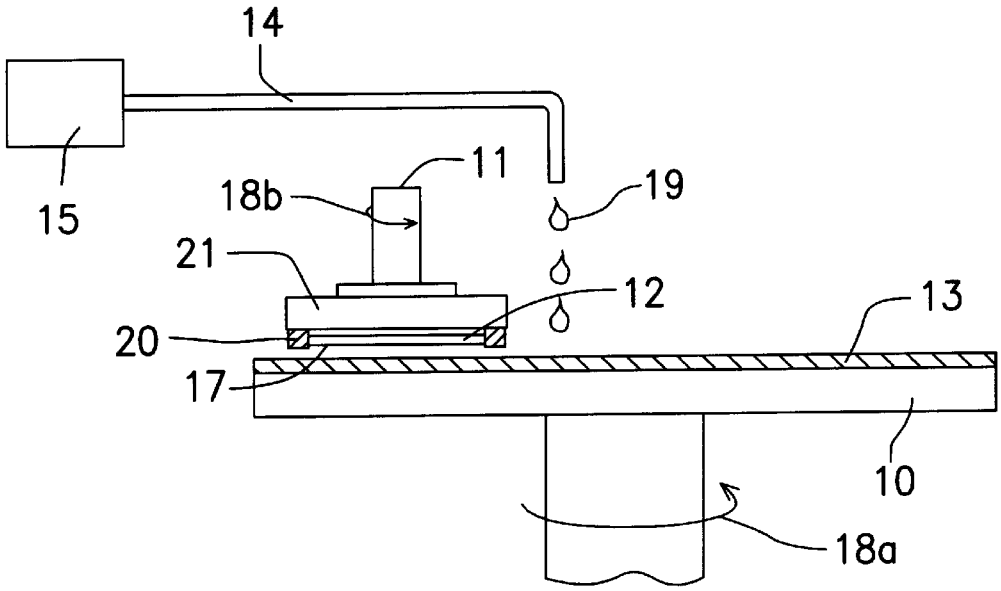
FIG. 1B (PRIOR ART)
FIG. 1B is a side-view of the components in a conventional chemical-mechanical polishing machine.
Figure 2:
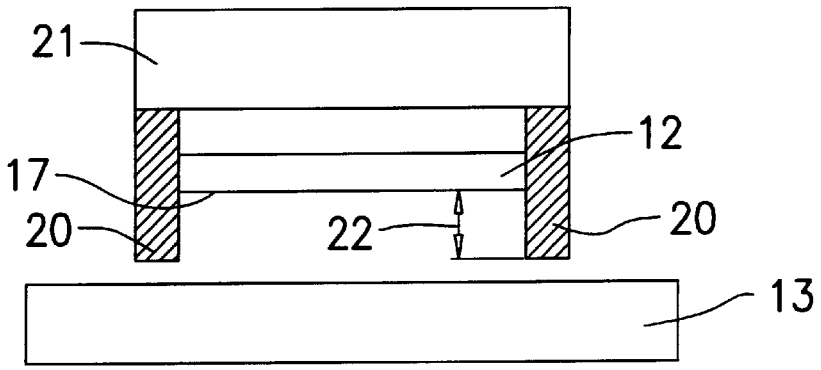
FIG. 2 (PRIOR ART)
FIG. 2 is a cross-sectional view showing the location of pocket depth in a wafer holding assembly.

Reference will now be made in detail to the present preferred embodiments of the invention, examples of which are illustrated in the accompanying drawings. Wherever possible, the same reference numbers are used in the drawings and the description to refer to the same or like parts.

Figure 3:
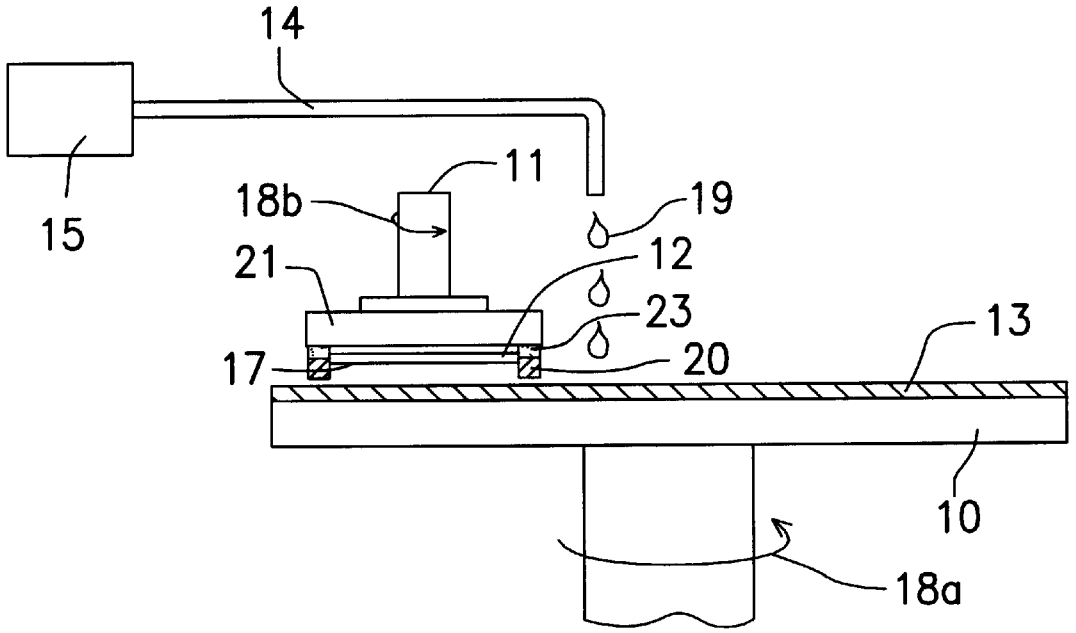
FIG. 3 is a side-view showing the installation for increasing the working life of the retaining ring in a chemical-mechanical polishing machine according to this invention.

FIG. 3 is a side-view showing the installation for increasing the working life of the retaining ring, which is made from ceramic materials or polyphenylene sulfide, in a chemical-mechanical polishing machine according to this invention.

As shown in FIG. 3, the chemical-mechanical polishing machine whose retaining ring has an extended life includes: a polishing table 10; a polishing pad 13 on top of the polishing table 10; a carrier 21 and a retaining ring 20 for grabbing a wafer 12; a pad 23 installed between the carrier 21 and the retaining ring 20; a spinning axle 11 for rotating the carrier 21; 1 a transporting pipe 14 for transporting slurry 19 to the polishing pad 13; and a pump 15 for pumping the slurry 19 through the transporting pipe 14. When polishing begins, the axle 11 rotates, driving the carrier 21 around at a definite speed. In addition, the polishing table 10 also rotates so that an easy-to-remove layer is formed on the front face 17 of the wafer 12 due to chemical reaction with chemical reagents in the slurry 19. Moreover, abrasive particles inside the slurry 19 also offer some abrasive action to help remove the protruding parts in the easy-to-polish layer. Consequently, by repeating the above chemical reaction and mechanical polishing action, a surface of high planarity can be obtained.

Figure 4:
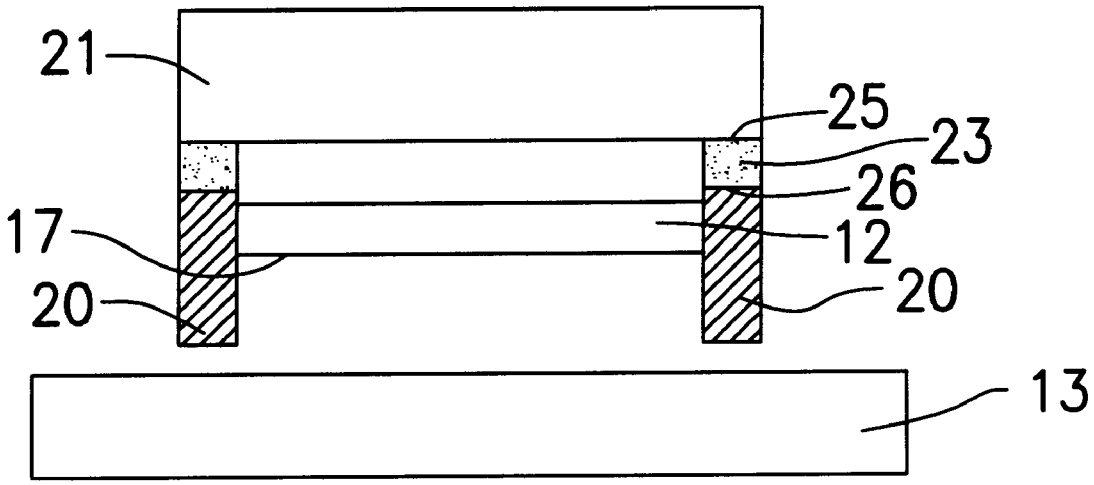
FIG. 4 is a cross-sectional view showing an assembly that includes a carrier and a retaining ring, and the extra pad placed between the two according to this invention.

FIG. 4 is a cross-sectional view showing an assembly that includes a carrier, a retaining ring and the extra pad placed between the two according to this invention. In FIG. 4, the pad 23 has a first surface 25 and a second surface 26. The first surface 25 is in contact with the carrier 21 and the second surface 26 is in contact with the retaining ring 20. In other words, a ring pad or a ring shim 23 preferably made from plastic, is attached to the lower peripheral surface of the carrier 21 and the retaining ring 20 is in turn attached to the plastic ring pad or ring shim 23. When the wafer holding assembly rotates to carry out wafer polishing, the ring pad or the ring shim 23 is able to stabilize the retaining ring 20 and spread out pressure by the polishing pad 13 applied to the wafer 12. Therefore additional wear due to the slippage of a retaining ring during a chemical-mechanical polishing action can be minimized. Furthermore, the ring pad or the ring shim 23 has a thickness of about 0.7 mm to 0.8 mm, and hence is able to allow some adjustment of the ceramic retaining ring 20 to reach the optimal pocket depth of around 0.3 mm. Ultimately, the working life of a retaining ring 20 undergoes a twofold increase, and so the consumption of expensive retaining rings 20 can be cut by half.

In summary, by inserting an additional pad between the carrier and the retaining ring, this invention is able to stabilize the retaining ring and prevent its slippage. In addition, pressure acting on a wafer can be more evenly spread and thus wear on the retaining ring can be lowered. Hence, the working life of a retaining ring can be increased and substantial cost can be saved.

It will be apparent to those skilled in the art that various modifications and variations can be made to the structure of the present invention without departing from 10 the scope or spirit of the invention In view of the foregoing, it is intended that the present invention cover modifications and variations of this invention provided they fall within the scope of the following claims and their equivalents.

What is claimed is:

1. A method for increasing the working life of retaining rings in a chemical-mechanical polishing machine where the polishing machine includes a carrier and a retaining ring for grabbing a wafer firmly when the chemical-mechanical polishing machine is in operation, the method comprising:

placing an additional pad between the carrier and the retaining ring to allow an adjustment in position of the wafer with respect to the retaining ring so that a gap between the bottom surface of the wafer and the bottom surface of the retaining ring can be maintained within a predetermined range.

2. The method of claim 1, wherein the step of placing the pad made from a plastic material.

3. The method of claim 1, wherein the step of placing the pad includes placing a pad having a thickness of about 0.7 mm to 0.8 mm.

4. The method of claim 1, wherein the step of placing the pad includes placing a first surface of the pad in direct contact with the carrier while placing a second surface of the pad in direct contact with the retaining ring.

5. A chemical-mechanic polishing machine, comprising:

a polishing table, having a first speed for polishing a wafer;

a slurry transporting pipe, to provide slurry onto the polishing table;

a carrier, to carrier the wafer during polishing;

a retainer ring, to retain the wafer under the carrier during polishing;

a pad, to stabilize the retain ring and to spread out pressure during polishing; and a rotating axle, having a second speed for rotating the wafer during polishing.

6. The chemical-mechanical polishing machine according to claim 5, wherein the polishing table further comprises a polishing pad thereon.

7. The chemical-mechanical polishing machine according to claim 5, wherein the material of the pad comprises plastic.

8. The chemical-mechanical polishing machine according to claim 5, wherein the pad has a thickness of about 0.7 mm to 0.8 mm.

9. The chemical-mechanical polishing machine according to claim 5, wherein the material of the retainer ring comprises ceramic.

10. The chemical-mechanical polishing machine according to claim 5, wherein the retaining ring is made from polyphenylene sulfide.

11. The chemical-mechanical polishing machine according to claim 5, wherein the pad is located between the carrier and the retaining ring.

* * * * *